United States Patent [19]

Barrat et al.

[11] 4,416,793

[45] Nov. 22, 1983

[54] LIQUID DETERGENT COMPOSITIONS CONTAINING AMINO-SILANES

[75] Inventors: Christian R. Barrat; John R. Walker, both of Brussels; Jean Wevers, Strombeek-Bever, all of Belgium

[73] Assignee: The Procter & Gamble Company, Cincinnati, Ohio

[21] Appl. No.: 421,187

[22] Filed: Sep. 22, 1982

[30] Foreign Application Priority Data

Sep. 25, 1981 [GB] United Kingdom ..... 8129069

[51] Int. Cl.[3] ..... C11D 9/36; C11D 3/30

[52] U.S. Cl. ..... 252/117; 252/110; 252/132; 252/174.15; 252/523; 252/525; 252/541; 252/544; 252/DIG. 14

[58] Field of Search ..... 252/132, 117, 110, 541, 252/544, 174.15, DIG. 14, 174.19, 559

[56] References Cited

U.S. PATENT DOCUMENTS

| | | | |
|---|---|---|---|
| 2,971,864 | 2/1961 | Speier | 427/388 |
| 2,972,598 | 2/1961 | Morehouse | 260/46.5 |
| 3,033,815 | 5/1962 | Pike et al. | 260/46.5 |
| 3,085,908 | 4/1963 | Morehouse et al. | 427/388 RX |
| 3,175,921 | 3/1965 | Hedlund | 427/409 |
| 3,876,459 | 4/1975 | Burrill | 427/387 |
| 3,992,332 | 11/1976 | Zenon | 252/548 |
| 4,005,024 | 1/1977 | Rodriguez et al. | 252/174.15 X |
| 4,005,025 | 1/1977 | Kinstedt | 252/547 X |
| 4,005,028 | 1/1977 | Heckert et al. | 252/99 |
| 4,005,030 | 1/1977 | Heckert et al. | 252/174.15 |
| 4,005,118 | 1/1977 | Heckert et al. | 252/546 |
| 4,062,999 | 12/1977 | Kondo et al. | 428/391 |
| 4,137,179 | 1/1979 | Koerner et al. | 252/8.6 |
| 4,152,273 | 5/1979 | Weiland | 252/8.8 |

FOREIGN PATENT DOCUMENTS

| | | |
|---|---|---|
| 753603 | 2/1967 | Canada . |
| 1793280 | 2/1972 | Fed. Rep. of Germany . |
| 2843709 | 4/1979 | Fed. Rep. of Germany . |
| 1207724 | 2/1960 | France . |
| 2299447 | 8/1976 | France . |
| 858445 | 1/1961 | United Kingdom . |

*Primary Examiner*—P. E. Willis, Jr.

*Attorney, Agent, or Firm*—Donald E. Hasse; Edmund F. Gebhardt; Robert B. Aylor

[57] ABSTRACT

Neutral to alkaline liquid detergent compositions containing organic surface-active agents, optionally detergent builders, and additive levels of particular amino-silanes are disclosed. These compositions provide outstanding washing machine compatibility, particularly if the detergent is used in conjunction with enamel-coated surfaces.

6 Claims, No Drawings

LIQUID DETERGENT COMPOSITIONS CONTAINING AMINO-SILANES

BACKGROUND OF THE INVENTION

This invention pertains to liquid detergent compositions having improved machine compatibility, particularly in relation to enamel-coated surfaces. These compositions broadly comprise a synthetic organic surface-active agent, as an optional ingredient a detergent builder, and an additive level of a specific amino-silane with the further proviso that the claimed compositions have a pH, measured as is, in the range from 6 to 12.

The claimed technology can find beneficial application in all kind of liquid detergent compositions, such as highly concentrated builder-free detergent compositions but also in liquid detergent compositions containing conventional levels of surface-active agents and conventional builders. The essential amino-silane components act in the same way as silicates currently used in granular detergent compositions. Thus, the amino-silanes provide compatibility to the washing machine, however, with the important difference that they are capable of providing benefits over a broader range of pH conditions, they are very easily processable, and are effective at very low levels as compared to e.g. current silicates.

During the past decade, there has been a standing desire to develop liquid detergent compositions for use in lieu of conventionally formulated, mostly built, solid detergent compositions. This development trend purports to meet the consumers' desires for using lower washing temperatures, inclusive of cold water laundering. Granular detergent compositions have, as of yet, not been fully adapted to these laundry variations because of weaknesses in respect to dissolving speed, product insolubility, and cleaning efficiency.

The formulation flexibility for liquid detergent compositions is limited, particularly in respect to inorganic materials such as silicates. The latter compound is essential, in solid detergents, to ensure adequate compatibility of the washing machine to the laundry liquor, in particular of enamel-coated surfaces. As of yet, no suitable silicate-substitutes for convenient use in liquid detergent composition have been developed. Thus, there was a standing need to make available suitable silicate-substitutes. A satisfactory substitute shall exhibit its functionality not solely at relatively high alkaline pH such as needed by silicates, but over a broad range of conditions extending from e.g. neutral to alkaline (pH 6–12) conditions as can be found in liquid detergents. The silicate-substitute shall furthermore be compatible to the physical state of the matrix and to the individual components, for example, it must allow the preparation of homogeneous compositions and not be subject to deactivation/precipitation phenomena.

Silanes and amino-silanes are widely used in the chemical industry, mostly as coupling agents between inorganic and organic surfaces. These compounds have also found application for metal-surface protection. The protective treatment is applied from an aqueous medium, possibly from solvent systems containing lower alcohols and water, depending upon the characteristics of the silanes. Representative of this state of the art are: U.S. Pat. No. 3,085,908, Morehouse et al., U.S. Pat. No. 3,175,921, Hedlund, and French Pat. No. 1.207.724, Morehouse et al.

The preparation of a broad class of gamma-aminopropylalkoxysilanes is known from German Application DOS No. 17 93 280.

Silanes, inclusive of amino-silanes, have been used in industrial fiber treatment technology, mostly in combination with polysiloxanes. This art is represented by German Patent Applications DOS Nos. 27 26 108; 14 69 324; DAS No. 23 35 751; and U.S. Pat. No. 4,152,273, Weiland.

Quaternized amino-silanes are known, from U.S. Pat. No. 4,005,118, Heckert et al. and U.S. Pat. No. 4,005,025, Kinstedt, to be suitable for conferring soil release properties to metallic and vitreous surfaces upon application from a wash or rinse-solution. The like quaternized amino-silanes, upon incorporation in aqueous detergents, are subject to deactivation, possibly following polymerization during storage.

It is also generally known that silane metal-surface treatment is usually carried out under slightly acidic conditions (pH 3–5) in order to prevent polymerization of the silane monomers in the aqueous medium which polymerization is known to decrease the effectiveness of the surface treatment.

It is an object of this invention to formulate liquid detergent compositions having machine compatibility comparable to silicate containing granular detergent compositions.

It is a further object of this invention to formulate homogeneous and storage stable liquid detergent compositions, i.e., compositions which are not subject to phase separation and deactivation upon storage.

Yet another object of this invention is to formulate liquid detergent compositions containing a machine compatibilizing agent which is, at least, as effective as conventional silicates while being used at lower levels.

SUMMARY OF THE INVENTION

This invention relates to liquid detergent compositions having improved machine compatibility particularly in relation to enamel-coated surfaces. The claimed compositions comprise:

(a) from 5% to 60% by weight of a synthetic organic surface-active agent;

(b) from 0% to 40% by weight of a detergent builder;

(c) from 0.001% to 1% by weight of an amino-silane having the formula

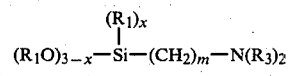

$R_1 = C_{1-4}$-alkyl or $C_{1-4}$-hydroxyalkyl;
x is 0 or 1;
m is 1–6;
$R_3$ is hydrogen, $R_1$, $C_{1-6}$-alkylamine, or

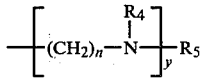

$R_4$ is hydrogen or $R_1$
n is 1–6
y is 0–6
$R_5 = R_4$, $$-(CH_2)_p-\underset{\underset{O}{\|}}{C}-OR_1, \text{ or } -\underset{\underset{O}{\|}}{C}-NHR_4;$$

p=1–6.

The $R_3$'s can be identical or different.

While the claimed technology can be applied to any kind of liquid detergent compositions, it was found to be particularly suitable for use in liquid detergents concentrated in surface-active agents, but also in liquid detergents containing fairly conventional levels of surface-active agents in combination with relatively high levels of builder ingredients.

The term "enamel" in enamel-coated is meant to embrace a vitreous opaque or transparent glaze fused over metal or pottery.

DETAILED DESCRIPTION OF THE INVENTION

It has now been discovered that liquid detergent compositions having significantly improved machine compatibility can be formulated with the aid of specific amino-silanes. In more detail, the claimed compositions contain: synthetic organic surface-active agents, an optional detergent builder component, a very low level of an amino-silane and have a pH, measured as is, in the mildly acid to alkaline range. The essential parameters, preferred executions, and preferred additives are described hereinafter.

Unless stated otherwise, the "percent" indications stand for "percent by weight of the composition."

The synthetic organic surface-active agents can be selected from nonionic, anionic, cationic, zwitterionic, amphoteric, and semi-polar nonionic surfactants and mixtures thereof. These surfactant components are normally used in levels ranging from 5% to 60%. The terms "surface-active agent" and "surfactant" are used interchangeably.

The nonionic surfactants are conventionally produced by condensing ethylene oxide with a hydrocarbon having a reactive hydrogen atom, e.g., a hydroxyl, carboxyl, amino, or amido group, in the presence of an acidic or basic catalyst. Nonionic surfactants have the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms, but can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, more preferably from about 12 to about 20 carbon atoms. A more complete disclosure of suitable nonionic surfactants can be found in U.S. Pat. No. 4,111,855 disclosed hereinbefore and incorporated herein by reference. Mixtures of nonionic surfactants can be desirable.

Synthetic anionic surfactants can be represented by the general formula $R^1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, monoalkanolammonium, dialkanolammonium, trialkanolammonium and mixtures thereof.

A preferred synthetic anionic surfactant is a water-soluble salt of an alkyl benzene sulfonic acid containing from about 9 to about 15 carbon atoms in the alkyl group. Another preferred synthetic anionic surfactant is a water-soluble salt of an alkyl polyethoxylate ether sulfate wherein the alkyl group contains from about 8 to about 24, preferably from about 10 to about 18 carbon atoms and there are from about 1 to about 20, preferably from about 1 to about 12 ethoxy groups. Other suitable anionic surfactants are disclosed in U.S. Pat. No. 4,170,565, Flesher et al., issued Oct. 9, 1979, incorporated herein by reference.

Suitable cationic surfactants are described in European Patent Application No. 0 028 865, page 5, line 32 to page 7, line 20, incorporated herein by reference.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and one contains an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975, said patents being incorporated herein by reference.

Ampholytic surfactants include derivatives of aliphatic heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures; water-soluble phosphine oxides containing one alkyl or hydroxy alkyl moiety of from about 8 to about 28 and two moieties selected from the group consisting of alkyl groups and hydroxy alkyl groups, containing from about 1 to about 3 carbon atoms; and water-soluble sulfoxides containing one alkyl or hydroxy alkyl moiety of from about 8 to about 28 carbon atoms and a moiety selected from the group consisting of alkyl and hydroxy alkyl moieties of from 1 to 3 carbon atoms.

For a more complete disclosure of compounds which are suitable for incorporation in detergent compositions, one can consult U.S. Pat. Nos. 4,056,481, Tate (Nov. 1, 1977); 4,049,586, Collier (Sept. 20, 1977); 4,040,988, Vincent et al. (Aug. 9, 1977); 4,035,257, Cherney (July 12, 1977); 4,033,718, Holcolm et al. (July 5, 1977); 4,019,999, Ohren et al. (Apr. 26, 1977); 4,019,998, Vincent et al. (Apr. 26, 1977); and 3,985,669, Krummel et al. (Oct. 12, 1976); all of said patents being incorporated herein by reference.

Qualitatively and quantitatively preferred surfactant systems for herein vary in accordance with the type of liquid formulation and with the choice of the major matrix components.

A preferred execution of this technology can be a substantially homogeneous concentrated soap containing liquid detergent wherein the surface-active agents other than soap comprise a mixture of non-soap anionic and nonionic surfactants in a weight ratio of from 4:1 to 1:4. The total surfactant is frequently in the range from 8% to 40%. The preferred individual anionic and nonionic surfactants are described in more detail in the following passage. The like concentrated compositions have frequently a pH, as is measured at 20° C., in the range from 7–9.

Suitable anionic surface-active agents are water-soluble sulfonate or sulfate salts have in their molecular structure an alkyl radical containing from about 8 to about 22 carbon atoms. Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 8 to 15 carbon atoms; sodium alkylglyceryl ether sulfonates; ether sulfates of fatty alcohols derived from tallow and coconut oils; coconut fatty acid monoglycerid sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880, incorporated herein by reference, can also be used. The neutralizing cation for the anionic synthetic sulfonates and/or sulfates is represented by conventional cations which are widely used in detergent technology such as sodium, potassium, lithium, amines and substituted amines. Suitable nonionic surface-active agents are the condensation products of a fatty alcohol having from 12 to 15 carbon atoms and from about 4 to 10 moles of ethylene oxide per mole of fatty alcohol. Species of this class of ethoxylates include: the condensation product of $C_{12}$–$C_{15}$ oxo-alcohols and 7 moles of ethylene oxide per mole of alcohol; the condensation product of $C_{13}$–$C_{15}$ oxo-alcohols and 7 or 9 moles of ethylene oxide per mole of fatty (oxo) alcohol; the condensation product of a narrow cut $C_{12}$–$C_{13}$ fatty (oxo) alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching particularly short chain such as methyl branching. A degree of branching in the range from 15% to 50% (weight %) is frequently found in commercial oxo-alcohols. Suitable nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

Another preferred execution of this technology can be a builder containing liquid detergent wherein the surface-active agent is represented by a ternary mixture of anionic, nonionic, and semi-polar detergent species. The nonionic surfactants can be similar to the species described in the preceding passage or can be represented by ethoxylated alkylphenols of the formula $R(OC_2H_4)_nOH$ wherein the alkyl radical has from 8 to 12 carbon atoms and wherein n is in the range from 3 to 9. Another preferred nonionic can be represented by up to about 10% of a fatty amide nonionic surfactant, such as ammonia amides, monoethanol amides, diethanol amides, and ethoxylated amides. Preferred amides are $C_{8-20}$ monoethanol amides, $C_{8-20}$ diethanol amides, and amides having the formula $$R-\overset{\overset{\displaystyle O}{\|}}{C}-\overset{\overset{\displaystyle H}{\|}}{N}-CH_2CH_2OCH_2CH_2OH,$$

wherein R is a $C_{8-20}$ alkyl group, and mixtures thereof. Particularly preferred amides are those where the alkyl group contains from about 10 to about 16 carbon atoms, such as coconut alkyl monoethanol or diethanol amide. Such compounds are commercially available under the tradenames Suppramide GR, from Onyx Chemical Co., Jersey City, N.J., Superamide F-3 from Rco, Inc. Conshohocken, PA, and Gafamide CDD-518, available from GAF Corp., New York, N.Y.

These amide components can be added to act as suds modifiers.

The amine oxide surfactant can be represented by conventional detergent amine oxides as disclosed hereinbefore, preferably $C_{12}$–$C_{16}$ alkyldimethylamine oxide. The weight ratio of nonionic to amine oxide surfactant in these referred built compositions is in the range from 1:1 to 4:1.

Preferred anionic surfactants for use in built liquid compositions are alkylbenzene sulfonates and/or alcohol polyethoxy sulfates and the salts thereof.

The compositions herein can further contain, as an optional ingredient, conventional water-soluble detergent builder of inorganic and/or organic nature. Well-known inorganic builders include: phosphates, pyrophosphates and polyphosphates. Suitable organic builders include: monocarboxylates such as $C_{12}$–$C_{18}$ soaps and polycarboxylate builders.

Suitable polycarboxylate builders include amino polycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of suitable polycarboxylate builder materials for use herein are sodium and potassium ethylene diamine tetraacetates, sodium and potassium nitrilotriacetates, the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103; and water-soluble salts of polycarboxylate polymers and copolymers as described in U.S. Pat. No. 3,308,067. Diehl, issued Mar. 7, 1967, incorporated herein by reference. A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid, and citraconic acid and copolymers with themselves.

In addition, other polycarboxylate builders which can be used satisfactorily include water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

It is to be understood that while the alkali metal, and particularly the potassium salts of the foregoing detergency builder salts are preferred for use herein from economic and solubility standpoints, the ammonium, alkanolammonium, e.g., triethanolammonium, diethanolammonium, monoethanolammonium and the like, water-soluble salts of any of the foregoing builder anions are also useful herein.

Other polycarboxylates for use herein are the polyacetal carboxylates described in U.S. Pat. No. 4,144,226, issued Mar. 13, 1979 to Crutchfield et al., and U.S. Pat. No. 4,146,495, issued Mar. 27, 1979 to Crutchfield et al., the disclosures of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution and converted to the corresponding salt.

Preferred polycarboxylate and polyacetate builders for use in the present invention are sodium and potassium nitrilotriacetate, sodium and potassium citrate, and mixtures thereof.

Water-soluble citrates, carboxymethyloxysuccinates, carboxymethyloxymalonates, and mixtures thereof are suitable detergency builders in that they are stable in liquid detergent compositions yet biodegradable and contain neither phosphorus nor nitrogen.

The builder component may be used in amounts up to 40% of the composition.

The substantially homogeneous built liquid detergents herein normally contain from 8% to 40% of non-soap anionic surfactants, nonionic surfactants or mixtures thereof; from 10% to 30% of a polycarboxylate builder; and from 0.01% to 0.5% of the amino silane in accordance with the invention, said composition having a pH, measured as is, in the range from 7–11 (20° C.).

The essential amino-silane component can be used in levels from 0.001% to 1%, preferably from 0.01% to 0.5%. Using less than 0.001% will not anymore produce the benefits of the invention whereas the use of levels above 1% will not provide additional benefits. The term amino-silane as used herein stands for the free amine form and for the corresponding salts such as e.g. hydrochloride salts, hydrosulfates or methosulfates.

The amino-silane component has the formula:

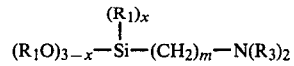

wherein:

$R_1 = C_{1-4}$-alkyl or $C_{1-4}$-hydroxyalkyl;

x is 0 or 1;

m is 1–6;

$R_3$ is hydrogen, $R_1$, $C_{1-16}$-alkylamine, or

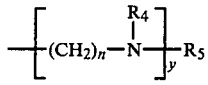

$R_4$ is hydrogen or $R_1$;

n is 1–6;

y is 0–6;

$R_5 = R_4$,

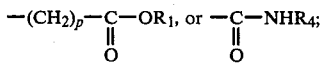

p = 1–6.

The $R_3$'s can be identical or different.

Preferred amino-silanes for use herein can carry the following substituents:

$R_1 = -CH_3$ or $-C_2H_5$ x = 0 m = 2 or 3

$R_3$ = hydrogen and

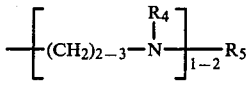

$R_4$ = hydrogen or methyl $R_5$ = hydrogen or methyl.

The most preferred amino-silanes have the following chemical formula:

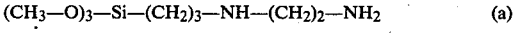

$(CH_3-O)_3-Si-(CH_2)_3-NH-(CH_2)_2-NH_2$ (a)

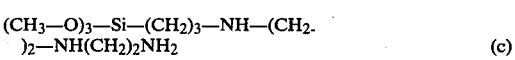

$(CH_3-O)_3-Si-(CH_2)_3-NH-(CH_2)_3-NH_2$ (b)

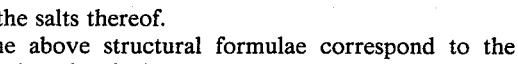

$(CH_3-O)_3-Si-(CH_2)_3-NH-(CH_2)_2-NH(CH_2)_2NH_2$ (c)

and the salts thereof.

The above structural formulae correspond to the following chemical names:

N-(trimethoxysilylpropyl)-ethylene diamine (a)

N-(trimethoxysilylpropyl)-propylene diamine (b)

N-(trimethoxysilylpropyl)-diethylene triamine (c)

The claimed amino-silanes are easily processable in liquid compositions and well-compatible to the individual ingredients. Surprisingly, it was also found that these silanes remain effective after periods of prolonged storage.

The pH of the composition, measured "as is" at 20° C., is from 6 to 12.

In addition to the essential ingredients and the builder component described hereinbefore, the compositions herein frequently can contain a series of optional ingredients which are used for their known functionalities in conventional levels. Examples of the like additives include: enzymes, particularly proteolytic and/or amylolytic enzymes; enzyme stabilizers such as short chain carboxylic acid/salts, e.g. formate at 2% level, and polyhydroxy alcohols, e.g. propane diols at 2%–10%; polyacids with a view to control heavy metals, e.g. aminopolyphonates such as ethylenediamine tetramethylenephosphonate, or diethylenetriamine pentamethylene phosphonate or aminocarboxylates such as ethylene diamine tetracarboxylate at a level of 0.3% to 1.2%; solvents such lower alcohols; suds regulants, preferably silicones; opacifiers; antioxidants such as BHT; bactericides; dyes; perfumes; brighteners and the like.

EXAMPLE I

Liquid detergent compositions were prepared by mixing the listed ingredients in the stated proportions.

| INGREDIENTS | COMPOSITIONS A | I |
|---|---|---|
| Linear dodecylbenzene sulfonic acid | 14 | 14 |
| Condensation product of one mole of C13-C15 OXO alcohol and 7 moles of ethylene oxide | 15 | 15 |
| Lauric acid | 6 | 6 |
| Myristic acid | 4 | 4 |
| Oleic acid | 5 | 5 |
| Triethanolamine | 5 | 5 |
| Sodium hydroxide to adjust pH to: | 7.7 | 7.7 |
| Ethanol | 10 | 10 |
| 1,2 propanediol | 4 | 4 |
| Proteolytic enzyme (a) | 0.05 | 0.05 |
| Calcium (b) | 2.0 | 2.0 |
| Sodium formate | 2.0 | 2.0 |
| Citric acid | 0.2 | 0.2 |
| Diethylenetriamine pentaphosphonic acid | 0.3 | 0.3 |
| Silane | — | 0.05 |
| Silicone suds regulane emulsion, brightener, perfume, opacifier, dye, antioxidant and water | BALANCE TO 100 | |

(a) MAXATASE ® supplied by GIST-BROCADES expressed on a 100% active basis.
(b) Added as calcium chloride and expressed as millimoles of calcium ion per kilo of composition.

The above compositions were used for comparative corrosion tests. The tests are carried out in a tergotometer whereby enamel-coated plate samples (10×5 cm) were fixed on the different agitators. The plates were immersed in the wash liquor (1.2% detergent concentration), kept under agitation at 85° C. The immersion test lasted 12 hours whereby the wash liquor was renewed every 3 hours. Enamel weight loss after testing was recorded and translated into a corrosion index as follows:

$$\frac{\text{enamel weight loss observed with composition } I}{\text{enamel weight loss observed with composition } A} \times 100.$$

Prior art composition A corresponds thus to a corrosion index of 100.

Amino-silanes in accordance with this invention and other silanes, incorporated in composition I, were compared for their effectiveness to protect enamel surfaces.

The testing results were expressed with the aid of the enamel corrosion index (ECI)

| COMPOSITION | SILANE TYPE | ECI |
|---|---|---|
| A | no silane | 100 |
| I a. | $(C_2H_5O)_3Si(CH_2)_3NH_2$ | 25 |
| I b. | $(CH_3O)_3Si(CH_2)_3NH(CH_2)_2NH_2$ | 10 |
| I c. | $(CH_3O)_3Si(CH_2)_3NH(CH_2)_2NH_2H$ | 15 |
| I d. | $(CH_3O)_3Si(CH_2)_2NH(CH_2)_2NH_2$ | 10 |
| I e. | $(CH_3O)_3Si(CH_2)_3NH(CH_2)_3NH_2$ | 13 |
| I f. | $(CH_3O)_2Si(CH_3)(CH_2)_3NH(CH_2)_2NH_2$ | 14 |
| I g. | $(CH_3O)_3Si(CH_2)_3NH(CH_2)_6NH_2$ | 16 |
| I h. | $(CH_3O)_3Si(CH_2)_3NH(CH_2)_2N(CH_3)_2$ | 22 |
| I i. | $(CH_3O)_3Si(CH_2)_3\overset{\oplus}{N}(CH_3)_2(CH_2)_2OCOC(CH_3)=CH_2$ | 75 |
| I j. | $(CH_3O)_3Si(CH_2)_3Cl$ | 100 |
| I k. | $(CH_3O)_3Si-CH=CH_2$ | 100 |
| I l. | $(CH_3O)_3Si(CH_2)_3SH$ | 75 |
| I m. | $(CH_3O)_3Si(CH_2)_3-O-CH_2-CH-CH_2$ (O) | 100 |
| I n. | $(CH_3O)_2Si(CH_2)_3-OCO-C(=CH_2)-CH_3$ | 100 |

These testing results confirm the consistent superiority of compositions in accordance with the invention (I a. to I h.) over composition A and as compared to structurally closely related silanes I i. to I n. different from the claimed species.

Composition I c., kept for 2 and 4 weeks at 35° C., was compared to an identical freshly made formulation I c. and to composition A. The % retained effectiveness was determined with the aid of the ECI, as described hereinbefore.

| | % retained effectiveness |
|---|---|
| Composition Ic.; freshly made | 100 |
| Composition Ic. after 2 weeks at 35° C. | 95 |
| Composition Ic. after 4 weeks at 35° C. | 80. |

This confirms the excellent and unexpected, compared to what was known from silane metal surface treatment from aqueous solutions, stability of aminosilane in liquid detergent matrixes.

The benefits of the invention were found to be provided at various pH as shown by comparative measurements with Composition I b. having a pH adjusted as indicated.

| | ECI |
|---|---|
| Composition A at pH 7.0/8.0/9.0 | 100 |
| Composition I b. at pH 7.0 as is | 20 |
| Composition I b. at pH 8.0 as is | 20 |
| Composition I b. at pH 9.0 as is | 15. |

EXAMPLE II

Liquid detergent compositions were prepared by mixing the listed ingredients in the stated proportions:

| INGREDIENTS | COMPOSITIONS B | COMPOSITIONS II |
|---|---|---|
| Condensation product of one mole of C12–13 oxo alcohol and 6.5 moles of ethylene oxide | 6.4 | 6.4 |
| C12–14 alkyl dimethyl amine oxide | 3.3 | 3.3 |
| C12–14 alkyl triethoxyether sulfate sodium salt | 2.9 | 2.9 |
| Coconut fatty acid monoethanol amine | 2.1 | 2.1 |
| Sodium salt of nitrilotriacetic acid | 18.2 | 18.2 |
| Potassium toluene sulfonate | 9.0 | 9.0 |
| Sodium hydroxide to adjust pH to 11.3 | — | 0.05 |
| N—(trimethoxysilypropyl)-ethylene diamine | | |
| Miscellaneous (perfume, brightener, dyes, sodium sulfite, oleic acid) | up to 100 | |

Comparative corrosion tests, similar to those described in Example I, were run under the following testing conditions: temperature 54° C.; 0.2% detergent concentration; 96 h. immersion. The comparative results expressed as ECI and loss of enamel gloss as measured with the aid of a Gardner gloss comparator, were as follows:

| COMPOSITIONS | ECI | % loss of enamel gloss |
|---|---|---|
| Composition B | 100 | 8 |
| Composition II | 20 | 1 |
| Regular silicated granular detergent (TIDE) | 40 | — |

These results confirm the high effectiveness of aminosilanes in liquid compositions. In addition, aminosilanes are at least as effective as silicate used in current granular detergents.

A series of additional liquid compositions are prepared.

The following abbreviations are used:

NaLAS=sodium salt of linear dodecylbenzene sulfonate

TEALAS=triethanolamine salt of linear dodecylbenzene sulfonate $NH_4LAS$=ammonium salt of linear dodecylbenzene sulfonate NaCnAS=sodium salt of sulfated $C_{12}$–$C_{14}$ alcohol Mg(CnAS)=magnesium salt of sulfate $C_{12}$–$C_{14}$ alcohol $NaCnAE_3S$=sodium salt of $C_{12}$–$C_{14}$ alkyl triethoxy ether sulfate $NH_4CnAE_3S$=ammonium salt of $C_{12}$–$C_{14}$ alkyl triethoxy ether sulfate $C_{12}$–$C_{13}EO_{6.5}$=condensation product of 1 mole of $C_{12}$–$C_{13}$ alcohol with 6.5 moles ethylene oxide Cn-amine oxide=$C_{12}$–$C_{14}$ alkyl dimethyl amine oxide DTDMAC=ditallowdimethylammonium chloride NTA=sodium salt of nitrilotriacetic acid TSPP=trisodium pyrophosphate STPP=sodium triphosphate EDTMP=ethylenediaminetetramethylphosphonate CnAmide=$C_{12}$–$C_{14}$ fatty acid monoethanolamide MEA=monoethanol amine KTS=potassium toluene sulfonate Miscellaneous: includes brighteners, dyes, propanediol, opacifiers, antioxidants, suds regulants, perfumes, bactericides, etc., and water.

Si-1=N-(trimethoxysilylpropyl)-ethylene diamine

Si-2=N-(trimethoxysilylpropyl)-N',N'-dimethylethylene diamine

Si-3=N-(trimethoxysilylpropyl)-propylene diamine

Si-4=N-(trimethoxysilylpropyl)-N',N'-dimethylpropylene diamine

Si-5=N-(trimethoxysilylpropyl)-diethylene triamine

Si-6=γ-aminopropyltriethoxysilane.

The silanes noted: Si-2; Si-4; and Si-6 have the following chemical formula:

$Si\text{-}2=(CH_3—O)_3—Si—(CH_2)_3—NH—(CH_2)_2—N(CH_3)_2$ $Si\text{-}4=(CH_3—O)_3—Si—(CH_2)_3—NH—(CH_2)_3—N(CH_3)_2$ $Si\text{-}6=(C_2H_5O)_3—Si—(CH_2)_3NH_2$.

| Category | EXAMPLES | | | | | | | | | | | |
|---|---|---|---|---|---|---|---|---|---|---|---|---|
| Formulation Type | III | IV | V | VI | VII | VIII | IX | X | XI | XII | XIII | XIV |
| NaLAS | 18.8 | 18.5 | | | | | 15.0 | 15.1 | | 5 | | 15.0 |
| TEALAS | | | | | | 20.0 | | | | | | |
| NH4LAS | | | 14.2 | | | | | | | | 2.0 | |
| NaCnAS | | | | | | | | | 3 | | | |
| Mg(CnAS)2 | | | 9.6 | | | | | | | | | |
| NaCnAE3S | 18.8 | | | | 12.5 | | | | | | | |
| NH4CnAE3S | | 18.5 | 11.4 | | | | | | | | | |
| Nonyphenol (EO)9 | | | | | | | | | 8.0 | | | |
| C12–13 EO6.5 | | | | 12.0 | 23.0 | | | | | 50 | | |
| C13–15 EO7 | | | | 11.0 | | | 15.0 | 7.3 | | | | 15.0 |
| C14–15 EO7 | | | | | | | | | | | 10.0 | |
| C14–15 EO4 | | | | | | 10.0 | | | | | | |
| C16–19 EO11 | | | | | | 20.0 | | | | | | |
| Cn amine oxide | | | | | | | | | 3.0 | | 5.0 | |
| DTDMAC | | | | 4.8 | | | | | | | | |
| NTA | | | | | | | | | | | 12 | |
| TSPP | | | | | | | | | | 32 | | |
| STPP | | | | | | | | | | | 10 | |
| Myristic fatty acid | | | | | | | | | | | | 4.0 |
| Lauric fatty acid | | | | | | | 10.0 | | | | | 6.0 |
| Na Citrate | | | | | 1.6 | 0.2 | 0.2 | 9.2 | 14 | | | 0.2 |
| EDTMP | | | | | | 0.3 | 0.3 | | | | | 0.3 |
| C18–22 fatty acid | | | | | | 0.5 | | | | | | |
| Enzyme | | | | | | 1.0 | 1.0 | | | 1.0 | | 1.0 |
| Na formate | | | | | | | 2.0 | | | | | 2.0 |
| Oleic acid | | | | | | | 5.0 | | | | | 5.0 |
| Cn amide | 2.0 | 4.1 | 4.0 | | | | | 4.8 | | | | |

-continued

| Category | EXAMPLES | | | | | | | | | | | |
|---|---|---|---|---|---|---|---|---|---|---|---|---|
| Formulation Type | III | IV | V | VI | VII | VIII | IX | X | XI | XII | XIII | XIV |
| TEA (MEA) | | | | | (2.0) | | 5 | | 1.5 | | | 5.0 |
| KTS | | | | | | | | 9.0 | 10 | | 7.0 | |
| Ethanol | 13.5 | 13.0 | 8 | 15.0 | | 10.0 | 9.0 | | | | | 9.0 |
| Si-1 | 0.08 | | | | | | | | | | 0.2 | |
| Si-2 | | | | | 0.1 | | .05 | | | | | |
| Si-3 | | | 0.06 | | | | | 0.1 | | | | |
| Si-4 | | 0.03 | | | | | | | 0.12 | | | |
| Si-5 | | | | 0.08 | | 0.06 | | | | 0.15 | | |
| Si-6 | | | | | | | | | | | | 0.1 |
| Miscellaneous | | | | | | balance to 100 | | | | | | |
| pH as is (20° C.) | 7.2 | 7.0 | 6.6 | 9.0 | 9.0 | 7.0 | 7.7 | 12.0 | 10 | 11.0 | 11.5 | 7.7 |

We claim:

1. A liquid detergent composition having improved machine compatibility, particularly in relation to enamel-coated surfaces, comprising:

(a) from 5% to 60% by weight of a synthetic organic surface-active agent;

(b) from 0% to 40% by weight of a detergent builder;

(c) from 0.001% to 1% by weight of an amino-silane having the formula

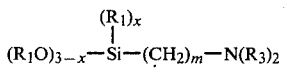

$R_1$=$C_{1-4}$-alkyl or $C_{1-4}$-hydroxyalkyl;
x is 0 or 1;
m is 1–6;
$R_3$ is hydrogen, $R_1$, $C_{1-6}$-alkylamine,

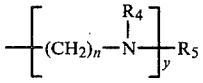

$R_4$ is hydrogen or $R_1$;
n is 1–6;
y is 0–6;
$R_5$=$R_4$,

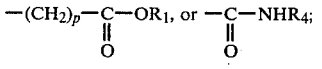

p=1–6;
said composition having a pH, as is, in the range from 6 to 12.

2. The composition in accordance with claim 1 wherein the amino-silane is present in an amount from 0.01% to 0.5% by weight.

3. The composition in accordance with claim 1 wherein the substituents of the amino-silane are as follows:
$R_1$=—$CH_3$ or —$C_2H_5$,
x=0
m=2 or 3
$R_3$=hydrogen and

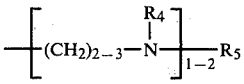

$R_4$=hydrogen or methyl
$R_5$=hydrogen or methyl.

4. The composition in accordance with claim 1 wherein the amino-silane is selected from the group consisting of:

$(CH_3—O)_3—Si—(CH_2)_3—NH—(CH_2)_2—NH_2$ $(CH_3—O)_3—Si—(CH_2)_3—NH—(CH_2)_3—NH_2$ and $(CH_3—O)_3—Si—(CH_2)_3—NH—(CH_2)_2—NH(CH_2)_2NH_2$.

5. A substantially homogeneous liquid detergent composition containing surface-active agents, fatty acid soaps and other conventional detergent additives, characterized in that it contains:

(a) from 20% to 40% by weight of a mixture of anionic surface-active agents and nonionic surface-active agents in a weight ratio of from 4:1 to 1:4;

(b) from 10% to 25% of a $C_{12}$–$C_{18}$ fatty acid soap; and (c) from 0.01 to 0.5 of the amino-silane in accordance with claim 1;

said composition having a pH, measured as is, in the range from 7 to 9.

6. A substantially homogeneous liquid detergent composition containing surface-active agents and other conventional additives, characterized in, that it contains:

(a) from 8% to 40% by weight of non-soap anionic surfactants, nonionic surfactants or mixtures thereof;

(b) from 10% to 30% by weight of a polycarboxylate detergency builder;

(c) from 0.01 to 0.5% of the amino-silane in accordance with claim 1, said composition having a pH, measured as is in the range of from 7 to 11.

* * * * *